US006359765B1

(12) United States Patent
Bier

(10) Patent No.: US 6,359,765 B1
(45) Date of Patent: Mar. 19, 2002

(54) FUSED TERMINAL FOR USE WITH A NETWORK PROTECTOR

(75) Inventor: Bruce Bier, Warren, NJ (US)

(73) Assignee: Richards Manufacturing Company, Irvington, NJ (US)

( * ) Notice: Subject to any disclaimer, the term of this patent is extended or adjusted under 35 U.S.C. 154(b) by 0 days.

(21) Appl. No.: 09/480,074

(22) Filed: Jan. 10, 2000

(51) Int. Cl.[7] ..... H01C 7/12
(52) U.S. Cl. ..... 361/119
(58) Field of Search ..... 361/119

(56) References Cited

U.S. PATENT DOCUMENTS 5,477,091 A * 12/1995 Florina et al. ..... 307/66
6,105,096 A * 8/2000 Martinelli et al. ..... 710/129
6,173,099 B1 * 1/2001 Kiernicki et al. ..... 385/78
6,243,273 B1 * 6/2001 Beun et al. ..... 361/796

* cited by examiner

*Primary Examiner*—Peter S. Wong
*Assistant Examiner*—Pia Tibbits
(74) *Attorney, Agent, or Firm*—Stroock & Stroock & Lavan LLP

(57) ABSTRACT

A fused terminal for use with a network protector, the disconnect terminal including an integral fuse and being located outside of the network protector housing and not substantially increasing the overall height of the network protector.

6 Claims, 4 Drawing Sheets

FUSED TERMINAL FOR USE WITH A NETWORK PROTECTOR

BACKGROUND OF INVENTION

The present invention is directed to power distribution connectors and, more particularly, to a terminal for a network protector having an integral fuse.

In New York, and in other major cities throughout North America, electricity is distributed from a utility company to customers via an electrical network; an electrical network being the most reliable, but also the most expensive method of electrical distribution. The electrical network generally consists of utility company high voltage sub-stations and distribution wiring, generally consisting of a number of high voltage cables called primary feeders (e.g., 13,800 volts) running in ducts under the city's streets. Various devices and interfaces connect the utility company and a customer such as, for example, a step-down transformer to step-down the voltage level generated and provided by the utility company and to ensure continued electrical service to the customer. At various points along the street the utility taps off the primary feeders to a primary side of a transformer that steps down the high voltage to a secondary voltage that is output from a secondary side of the transformer and that may be used directly by the utility's customers. In the United States, this secondary voltage may be either 120/208 volts or 277/480 volts, depending on the application. The secondary sides of a plurality of transformers are tied together to form a single electrical grid from which individual cables feed the end user or utility customer (also referred to herein as a secondary-side network).

The major advantage of the grid configuration of the secondary-side network is reliability. Because a number of transformer secondaries are tied together, an electrical fault on one of the transformers or one of the high voltage feeders does not deprive the customer of electricity. The remaining transformers pick up the load while the fault is repaired. The major disadvantage is that, because the transformer secondaries are tied together, absent some form of sectionalizing device, a fault on any one of the primary feeders would have disastrous consequences. The current flowing into the secondary-side network via the undamaged feeders would back-feed out of the secondary-side network via the damaged feeder's transformer towards the fault. This would result in customer power outages.

To avoid back-feeds, a sectionalizing device called a network protector is placed at the secondary side of the transformer. The network protector operates as a large switch between the transformer and the secondary-side network. The network protector (i.e., the switch) is housed in a steel box commonly referred to as a network protector housing. When utilities place network protectors in underground vaults, they use a submersible network protector housing which is designed to exclude water from the interior of the housing, even if the housing is completely submerged.

The network protector automatically opens and remains opened when current would flow out of the secondary-side network. The network protector is also designed to close and remain closed when current is flowing into the secondary-side network. When the network protector is operating correctly, a fault on its primary feeder will cause the network protector to open. When all the network protectors connected to the damaged feeder open, that damaged feeder will be electrically isolated from the secondary-side network and the back-feed of current will be arrested. In the event the network protector should fail to operate due to mechanical malfunction, it is necessary to isolate the network protector and transformer from the secondary grid. Fuses are installed on the secondary-side network of the network protector such that if the network protector fails to open when necessary, the feeder can be grounded causing those fuses to blow.

A fault on the secondary-side network of the network protector will not cause the network protector to open. Despite this fact, such a fault can have damaging consequences. It can cause large quantities of current to flow into the secondary-side network towards the fault. The heat generated by these large quantities of current may reach a level at which the network protector or the transformer is severely damaged. Another function of the network protector fuses, discussed above, is to avoid this possibility. If current through the fuse reaches a certain level, these fuses will blow and damage will be averted.

Because the network protector is mounted between the transformer and the secondary-side network, current normally flows through the network protector from the transformer to the secondary-side network. The network protector is connected to the secondary-side network via a plurality of terminals that exit from the top of the network protector housing.

Network protectors have undergone a number of design changes from the time they were introduced (around the 1920's) to the present. The first relevant designs were created by General Electric (G.E.) and Westinghouse Electric in the 1930s. The G.E. and Westinghouse designs had a number of similarities. In both cases the network protector fuses were located inside the network protector housing. Locating the fuse within the housing provided for a compact design of the network protector. In some cities, utilities pay taxes based on the amount of property its equipment occupies (e.g., network transformers and network protectors). Since city real estate is relatively expensive, height is a critical consideration for any network protector design.

However, internal fuses radiate a significant amount of heat. As heat inside the network protector housing increases, the current-carrying capacity of the fuses decreases. In addition, there is no forced-air cooling within the network protector housing; only ambient cooling is provided by cooling fins on the outside of the network protector housing. The heat generated by the internal fuses thus represents a limitation on the current-carrying capacity of a network protector.

Internal fuses may also lead to damage to the network protector. The most common fuse design is a link of copper that is bolted into the network protector housing to form a path for current to flow between the network protector and the secondary-side network. In the center of the fuse, the width of the copper is significantly reduced. At a certain temperature (i.e., at a certain level of current flow), the thin section of the fuse melts thus breaking the connection between the network protector and the secondary-side network. Problems result when severe secondary faults result in a rapid rise in the quantity of current flowing through the network protectors. The fuses may then blow violently spraying molten copper throughout the interior of the network protector housing. In addition to being messy, on 277/480 volt network protectors, this can result in damage due to arcing in the network protector housing.

In the 1970s, Westinghouse Electric developed a network protector which attempted to eliminate the disadvantages of internal fuses. The Westinghouse CMD network protector placed the network protector fuses outside the network protector housing. The fuses were housed in small boxes that were mounted on the top of the network protector housing. The network protector terminals were then mounted above the fuse boxes. By placing the fuses outside of the network protector housing, Westinghouse eliminated both disadvantages of internal fusing. The heat of the fuses was removed from the housing, which allowed Westinghouse to increase the current capacity of the network protector. Westinghouse was thus able to manufacture a lighter, less expensive network protector while maintaining the same current capacity as the older designs. Because the fuses were removed from the network protector housing, Westinghouse had also eliminated the problem of splattering molten copper resulting from a violent blowing of the fuses.

While Westinghouse had eliminated the major weakness of internal fusing, it had also eliminated the major advantage. By placing the fuses on top of the network protector and the terminals on top of the fuses, the Westinghouse CMD network protector increased the overall height of the network protector, thus increasing the amount of space occupied by the network protector in the utilities' vault.

It is thus desirable to provide a network protector having a terminal or interface to the secondary-side network that overcomes the above-described shortcomings of the prior art.

SUMMARY OF THE INVENTION

The present invention is directed to a fused terminal for use with a network protector.

In one embodiment, the present invention comprises a fused terminal for use in a network protector having a predetermined height and being provided between a high-voltage primary feeder cable and a secondary-side network of an electrical network. The fused terminal is located outside of the network protector housing and provides a fused electrical connection between the network protector and the secondary-side network. The fused terminal comprises an input terminal sized and shaped to releasably engage an output receptacle of the network protector. The fused terminal also includes an output terminal for providing an electrical connection tot the secondary-side network and a fuse electrically connected between the input and output terminals. The fused terminal does not substantially increase the height of the network protector and additionally includes a housing encasing the input and output terminals.

In another embodiment, the present invention comprises a network protector contained in a housing and adapted for use in an electrical network and for providing an electrical connection between a high-voltage primary feeder cable and a secondary-side network of the electrical network. The network protector of this embodiment has a predetermined height and comprises an electrical input connected to a transformer which is connected to the high-voltage primary feeder cable and a fused output terminal located outside of the network protector housing and not substantially increasing the height of the network protector and providing a fused electrical connection between the network protector and the secondary-side network. The fused output terminal comprises an input terminal sized and shaped to releasably engage an output receptacle of the network protector and an output terminal for providing an electrical connection to the secondary-side network. The fused output terminal also includes a fuse electrically connected between the input and output terminals and a housing encasing the input and output terminals.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference characters denote similar elements throughout the several views.

DETAILED DESCRIPTION OF THE PRESENTLY PREFERRED EMBODIMENTS

The present invention is directed to a terminal for a network protector that includes an integral fuse and that may be located outside of the network protector housing.

Figure 1:
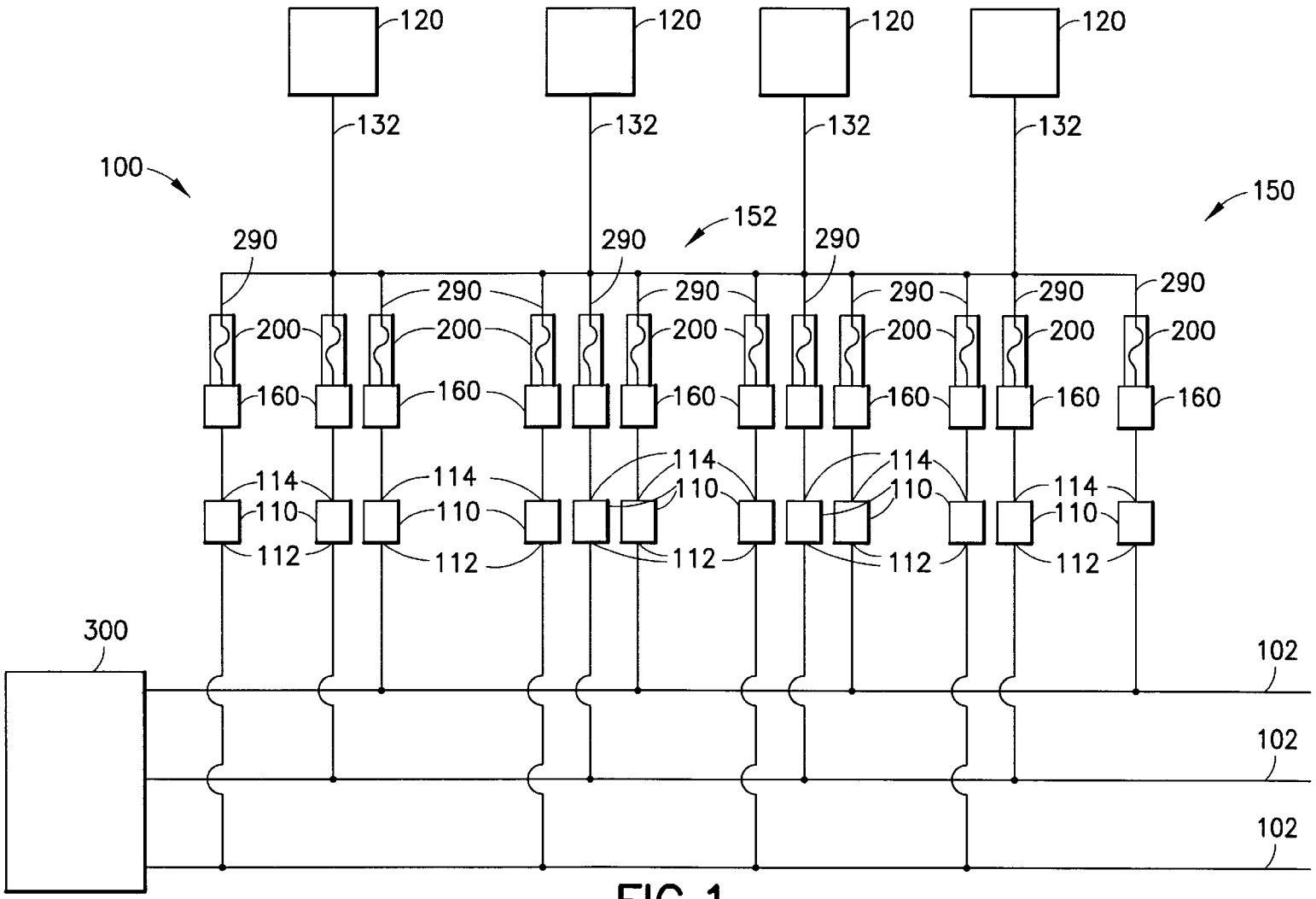
FIG. 1 is a schematic drawing of an electrical network including a network protector connected between a transformer and a customer in accordance with the present invention.

Referring now to the drawings in detail, FIG. 1 schematically depicts an electrical network 100 including a plurality of high-voltage primary feeder cables 102 connected to a utility company 300 that generates and provides power to the plurality of feeder cables 102. The electrical network 100 also includes a secondary-side network 150 that provides power to a plurality of utility customers 120. The secondary-side network 150 includes a plurality of low-voltage feeder cables 132 that run from a grid 152 directly to the customers 120.

Various devices are provided to interface between the feeder cables 102 and secondary-side network 150. A step-down transformer 110 is provided to step-down the high-voltage being carried on the primary feeder cables 102 to a voltage that may be used directly by the customers 120. For example, the voltage on the primary feeder cables 102 may be in the range of approximately 13,800 volts, while the desired customer voltage may be in the range of approximately either 120/208 volts or 277/480 volts, depending on the application. A primary side 112 of the transformer 110 connects to the high-voltage feeder cable 102.

A network protector 160 is connected to the secondary side 114 of the transformer 110 and electrically isolates the secondary-side network 150 from the feeder cables 102 when a fault (e.g., a short circuit) exists on a primary feeder cable 102. The network protector 160 operates as a large switch between the transformer 110 and the secondary-side network 150. The network protector 160 automatically opens and remains opened when current would flow out of the secondary-side network 150. The network protector 160 is also designed to close and remain closed when current is flowing into the secondary-side network 150. When the network protector 160 is operating correctly, a fault on its primary feeder cable 102 will cause the network protector 160 to open. Each of a plurality of network protectors 160 connected to a damaged primary feeder cable 102 will open when a fault is present on that feeder cable 102. Consequently, that damaged feeder cable 102 will be electrically isolated from the secondary-side network 150 and the back-feed of current from the secondary-side network 150 to the feeder cables 102 may be avoided.

Figure 2:
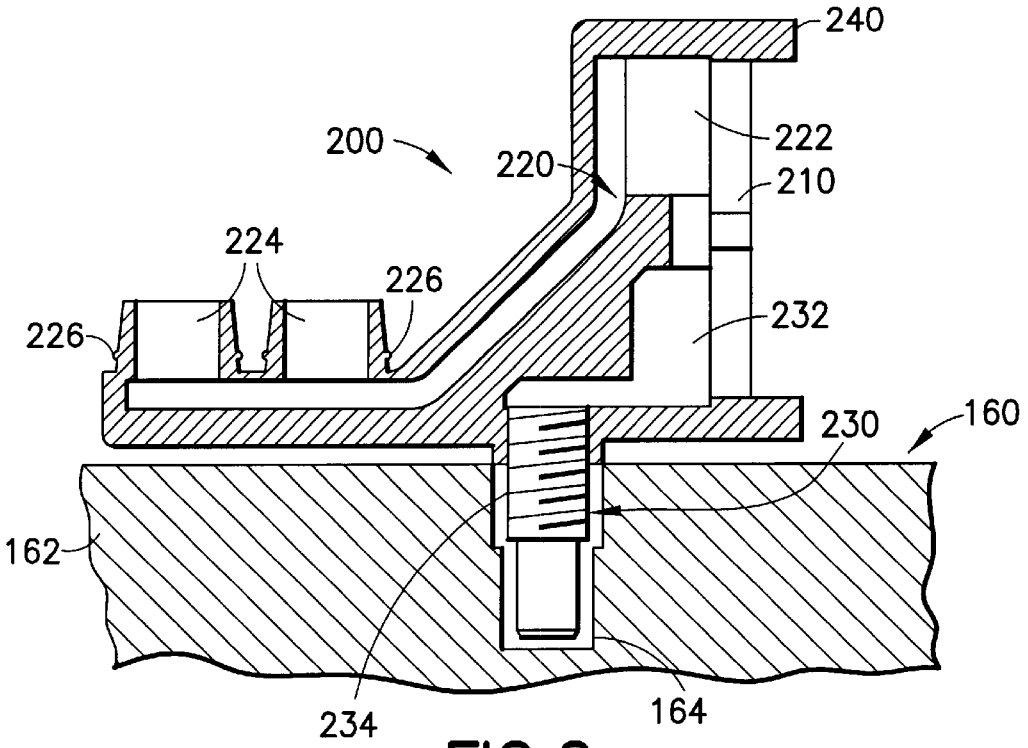
FIG. 2 is a partial cross-sectional side view of a fused terminal for a network protector constructed in accordance with the present invention.

The network protector 160 is housed in a steel box commonly referred to as a network protector housing 162 (see, e.g., FIG. 2). When utilities place network protectors 160 in underground vaults, they use a submersible network protector housing which is designed to exclude water from the interior of the housing, even if the housing is completely submerged.

Figure 3:
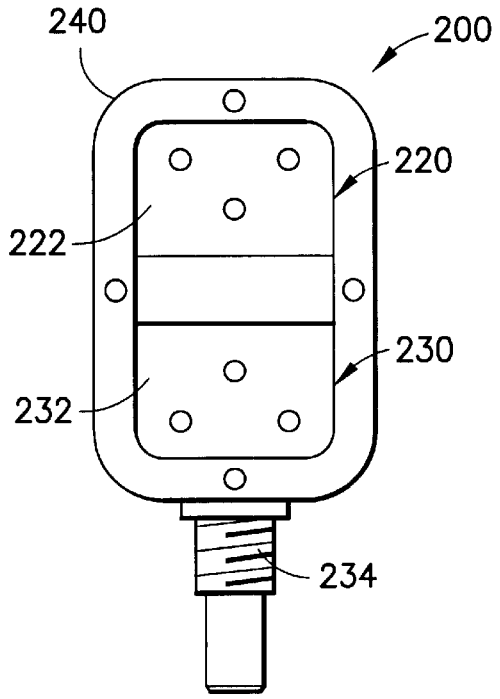
FIG. 3 is a right-side view of the fused terminal of FIG. 2.
Figure 4:
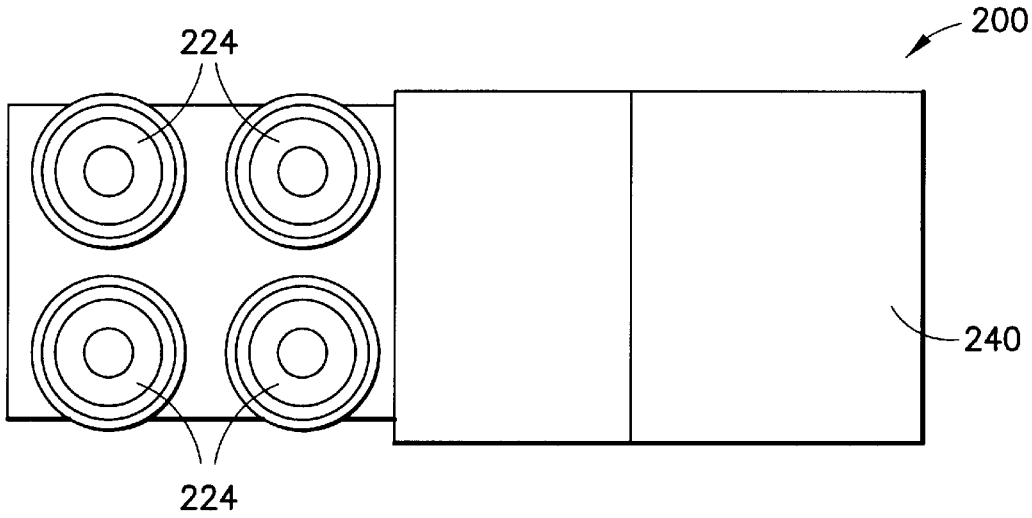
FIG. 4 is a top view of the fused terminal of FIG. 2.

With continued reference to FIG. 1 and with additional reference to FIGS. 2–4, a fused disconnect terminal 200 is provided at the output of the network protector 160 and between the network protector 160 and the secondary-side network 150. The fused terminal 200 includes an input terminal 230 having a leg section 234 that is sized and shaped to releasably engage a receptacle 164 of the network protector 160. The input terminal 230 also includes a fuse mount 232 to which a fuse 210 (see also FIG. 5) may be removably secured. The fused terminal 200 also includes an output terminal 220 having a fuse mount 222 to which the fuse 210 may be removably secured. A fuse 210 mounted to the fuse mounts 222, 232 of the output and input terminals 220, 230, respectively, provides a severable electrical connection between those terminals. The output terminal 220 also includes a plurality of quick-connect receptacles 224 connected in parallel with the fuse mount 222 to provide a plurality of output points from the fused terminal 200 to the secondary network 150.

Figure 6:
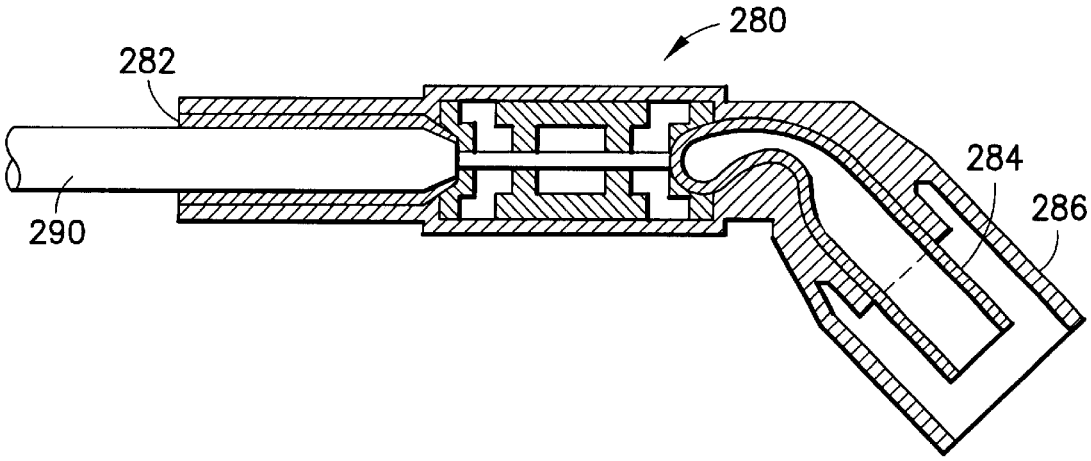
FIG. 6 is a cross-sectional view of a quick-disconnect terminal for a fused terminal constructed in accordance with the present invention.

The fused terminal 200 is encased in a housing 240, constructed of an epoxy or other similar material and, is preferably substantially non-conductive. The housing 240 may provide electrical isolation between the input terminal 230 and output terminal 220. A lip 226 is defined in the housing 240 about the perimeter of each quick-connect receptacle 224 that engages a silicone rubber skirt 286 (see, e.g., FIG. 6) provided on a quick-disconnect terminal 280 to provide a water-tight seal therebetween.

Figure 5:
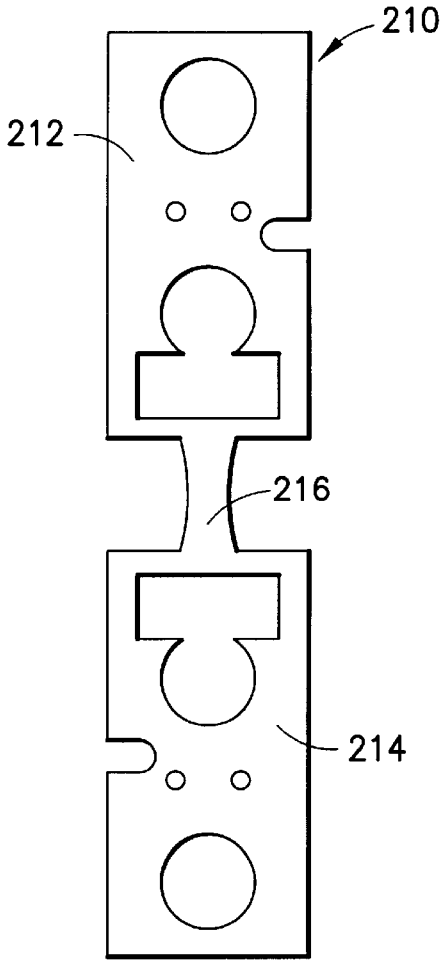
FIG. 5 is a front view of a fuse used in the fused terminal in accordance with the present invention.

Referring next to FIG. 5, a fuse 210 for use in the fused terminal 200 is there depicted. The fuse 210 includes first and second ends 212, 214 having substantially the same width and a mid-section 216 disposed between the two ends 212, 214 and having a width that is substantially narrower than the width of the two ends 212, 214. The fuse 210 may be constructed of, for example, copper or other material providing the desired conducting properties and further providing for the melting, breakage, etc., of the mid-section 216 when a predetermined amount of current passes through the fuse 210. The fuse 210 depicted in FIG. 5 is provided as an illustrative, non-limiting example of a fuse for use in the fused terminal 200 of the present invention.

Connection between the network protector 160 and the secondary-side network 150 is via a plurality of quick-disconnect terminals 280 that are sized and shaped to releasably engage the quick-connect receptacles 224. The quick-disconnect terminal 280 includes a crimp terminal 282 which may be crimped to a cable 290 that makes up a part of the secondary-side network 150. The crimp terminal 282 is electrically connected, internal to the quick-disconnect terminal 280, to a terminal 284 that electrically connects with the quick-connect receptacle 224 of the network protector 160. A silicone rubber skirt 286 is provided about the quick-disconnect terminal 280 which forms a water tight seal with the lip 226 and housing 240 disposed about the receptacles 224.

The quick-disconnect terminal 280 provides for a quick and reliable connection between the secondary-side network 150 and the network protector 160. In use, a cable 290 provided as part of the secondary-side network 150 is inserted into and crimped in the crimp terminal 282 of a quick-disconnect 280. The quick-disconnect terminal 280 may then plugged into a quick-connect receptacle 224 of the fused terminal 200 provided on the network protector 160. The silicone rubber skirt 286 of the quick-disconnect terminal 280 and the epoxy housing 240 of the fused terminal 200 provide a water-tight seal for the connection between the terminal 284 of the quick-disconnect terminal and the quick-connect receptacle 224 of the fused terminal 200. The quick-disconnect terminal 280 also permits for a water-tight connection between the secondary network 150 and the network protector 260 without the need for time consuming secondary operations such as, for example, taping, bolting, etc.

In addition, the fused terminal 200 and quick-disconnect terminal 280 are constructed so that the height of the network protector 160 is not substantially increased when the fused terminal is connected thereto. Thus, the present invention provides an external fuse for the network protector 160 and a quick-disconnect terminal 280 for an output of the network protector 160, neither of which increase the height or otherwise change the spatial parameters and spatial installation requirements of the network protector 160. The fused terminal 200 of the present invention provides the desired protection against short-circuit conditions on a feeder cable 102 and eliminates the undesirable effects of including a fuse within the network protector housing 162, without increasing the spatial installation requirements of a network protector. The present invention also advantageously provides a quick-disconnect feature for connection between a network protector 160 and the secondary-side network 150.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A fused terminal for use with a network protector having an output receptacle and a housing having a predetermined height, the network protector being electrically connectable between a high-voltage primary feeder cable and a secondary-side network of an electrical network, said fused terminal being located outside of the network protector housing and electrically connecting the network protector and the secondary-side network, said fused terminal being adapted to receive a fuse for providing a fused electrical connection between the network protector and the secondary-side network, said terminal comprising:

a terminal sized and shaped to releasably engage the output receptacle of the network protector;

a quick-connect terminal for providing a quick-connect electrical connection to the secondary-side network; and a housing encasing said terminal and said quick-connect terminal;

wherein said terminal, said quick-connect terminal and said housing are sized and shaped so as to not change the predetermined height of the network protector when said fused terminal is engaged with the output receptacle of the network protector.

2. A fused terminal as recited by claim 1, wherein said housing is made from an epoxy.

3. A fused terminal as recited by claim 1, further comprising a fuse electrically connected between said terminal and said quick-connect terminal.

4. A fused terminal as recited by claim 3, further comprising:

a fuse mount provided on said terminal and on said quick-connect terminal and to which said fuse is removably secured;

a leg provided on said terminal and electrically connected with said fuse mount on said terminal and complementarily sized and shaped with the output receptacle of the network protector; and a lip defined on said housing peripherally about said quick-connect terminal.

5. A fused terminal as recited by claim 4, further comprising a quick-disconnect terminal having a first terminal for connection to the secondary-side network and a second terminal for releasable connection to said quick-connect terminal, said quick-disconnect terminal further comprising a skirt for engaging said lip and for forming a watertight seal therewith.

6. A fused terminal as recited by claim 3, wherein said fuse has a first end, a second end, and a mid-section disposed therebetween, said first end and said second end being substantially the same width and said mid-section being narrower in width than said first and said second ends.

* * * * *